United States Patent [19]

Biller et al.

[11] 4,387,812

[45] Jun. 14, 1983

[54] INTERMEDIATE CABLE SUPPORT

[75] Inventors: Cleveland J. Biller, Morgantown; David D. Johnson, Booth, both of W. Va.

[73] Assignee: The United States of America as represented by the Secretary of Agriculture, Washington, D.C.

[21] Appl. No.: 242,513

[22] Filed: Mar. 10, 1981

[51] Int. Cl.[3] ..... B63C 19/00

[52] U.S. Cl. ..... 212/176; 212/71; 104/115

[58] Field of Search ..... 104/115, 112; 105/150-152; 212/71-123

[56] References Cited

U.S. PATENT DOCUMENTS

| | | | |
|---|---|---|---|
| 717,570 | 1/1903 | Harding | 104/115 |
| 978,134 | 12/1910 | Buck | 104/115 |
| 1,003,950 | 9/1911 | Rosada | 104/115 |
| 1,087,062 | 2/1914 | Izett | 104/115 |
| 1,222,007 | 4/1917 | McGuire | 104/115 |

FOREIGN PATENT DOCUMENTS

| | | | |
|---|---|---|---|
| 108191 | 12/1927 | Austria | 104/115 |

*Primary Examiner*—Galen L. Barefoot
*Assistant Examiner*—Stephen P. Avila
*Attorney, Agent, or Firm*—M. Howard Silverstein; David G. McConnell

[57] ABSTRACT

A skyline intermediate support for use in cable logging systems and a logging carriage are shown and described. The intermediate skyline support permits the skyline cable to pass freely through the intermediate support while positively retaining the cable on the support, and allows the logging carriage to pass over the top of the intermediate support, with freedom to allow for a rocking motion in the carriage.

8 Claims, 4 Drawing Figures

INTERMEDIATE CABLE SUPPORT

This application is related to, in the sense that it has some common subject matter, to the three co-pending patent applications as follows:

Ser. No. 102,484 by Joseph W. Gorsh, titled "Running Skyline Intermediate Support and Multi-span Carriage", U.S. Pat. No. 4,347,938.

Ser. No. 115,538 by Cleveland J. Biller titled "Intermediate Support for a Skyline Logging System", U.S. Pat. No. 4,355,727.

Ser. No 210,460 by Cleveland J. Biller and David D. Johnson titled "Carriage for Cable Logging System" abandoned.

BACKGROUND OF THE INVENTION

This invention relates to cable logging systems, and more particularly to systems which are long and which require an intermediate support. Intermediate supports are used to lengthen the harvest span by raising the cable system up, so that the cable does not touch the ground at an intermediate point. In skyline logging systems which slacken the skyline cable when attaching or releasing loads, it is essential that the intermediate support permit the cable to pass freely through the support in order to prevent unnecessary wear or abrading of the cable. In U.S. Pat. No. 1,222,007 there is shown an intermediate support in FIGS. 12 and 15 which holds the cable up on grooved track and which allows the carriage sheave wheels to pass directly over the cable as it rolls across the support. This system will produce substantial cable wear as it is slackened and tightened, the cable will tend to flip off of the support, and the cable will be clamped between the carriage sheave wheels and the support when the wheels pass over the support. Each of these features will cause cable abrasion and wear in cable logging systems where the cable is slackened to raise and lower the log being transported.

SUMMARY OF THE INVENTION

This invention is an improved intermediate support which provides for free passage of the skyline cable through the intermediate support at all times. In the preferred embodiment this free movement is provided by sheave wheels on the support. Means are provided to allow the logging carriage to pass over the top of side plates on the intermediate support. This permits the carriage to disengage from the skyline cable during travel across the support. This disengagement further allows for movement of the skyline cable and makes it possible to retain the cable on the support when the cable is slackened and tightened during logging operations. The cable retention means of the preferred embodiment is a pair of bolts passing through the side plates above the support sheave wheels and below the top of the side plates.

DESCRIPTION OF THE PREFERRED EMBODIMENT

Figure 1:
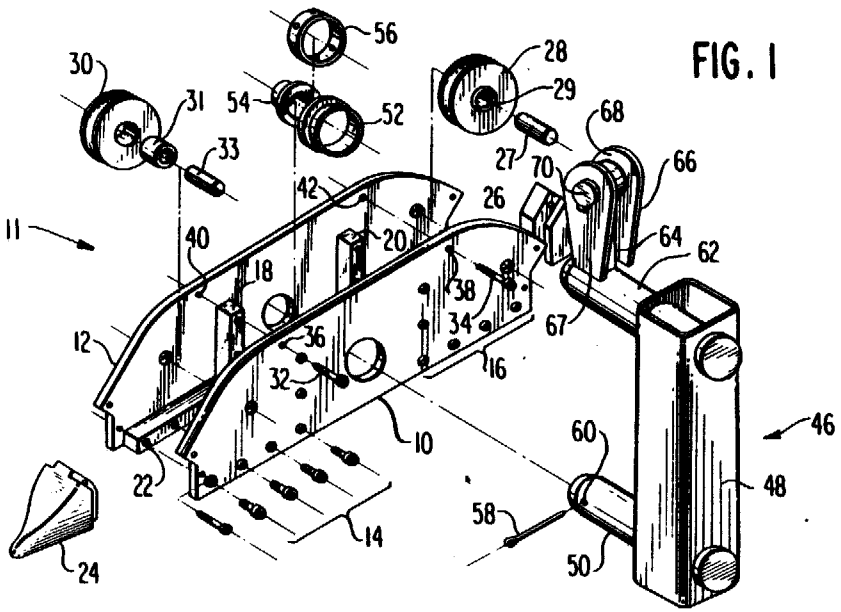
FIG. 1 shows an exploded view of the intermediate support and support hanger.

The intermediate support is shown generally in the exploded view of FIG. 1. This support is to be used in skyline logging systems where in the main logging skyline cable is raised and lowered when logs are attached or removed from the system. It is absolutely essential that the skyline cable be free to pass through the support without excessive friction and cable wear, and that the cable be prevented from flipping off of the support at all times.

Figure 2:
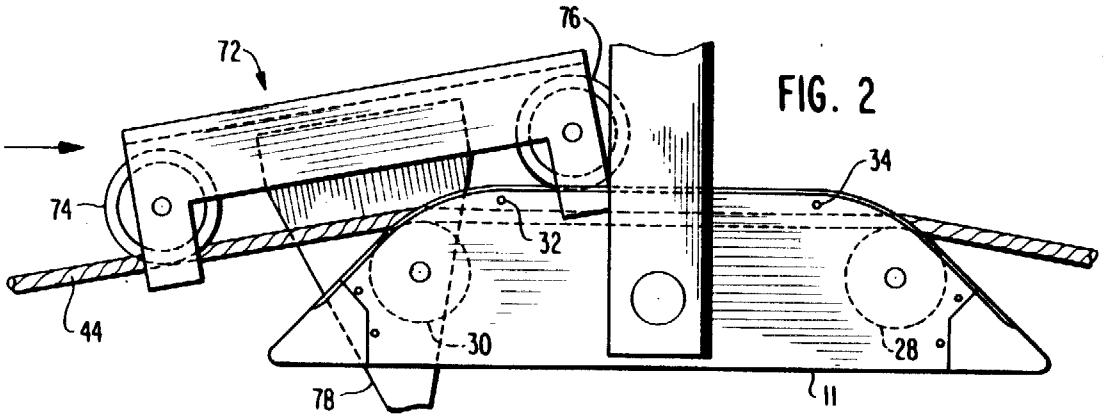
FIG. 2 shows a side view of the intermediate support while a logging carriage is initially passing over the top of the support side plates.

In FIG. 1, there is shown the side plate assembly generally depicted as 11. Parallel side plates 10 and 12 are bolted together by a plurality of bolts generally depicted as 14 and 16. Plates 10 and 12 also lie generally parallel to cable 44 as shown in FIG. 2. Between the side plates are spacer block means 18, 20 and 22 through which the bolts 14 and 16 pass. The spacer blocks maintain plate separation and contribute to the rigidity of the entire side plate assembly 11.

Located at each end of the intermediate support are end nose block means 24 and 26 which provide for plate separation and rigidity as do the spacer blocks 18, 20, and 22. The end nose block means also guides a slackened cable to the support during attachment and removal of logs, also providing means to open carriage skyline locks.

Mounted between side plates 10 and 12 are sheave wheels 28 and 30 which are the means for allowing skyline cable 44 to pass freely through the intermediate support. Two sheave wheels are shown, but another number may be used, and their location may vary. Since the purpose of the sheave wheels is to provide for free non-abrading passage of the cable during logging operations, other low friction non-abrading means may be used. The sheave wheels are supported by bushing 29 and 31 which are held in place by pully shafts 27 and 33. Pully shafts 27 and 33 are in turn supported by plates 10 and 12.

Allen bolts 32 and 34 are placed at the top of the side plates 10 and 12. These allen bolts serve as the cable retention means. As can be seen in FIG. 2, these bolts are located above the line of travel of the skyline cable 44. In this embodiment, the head of the bolts fits into plate 10, and plate 12 is threaded to receive bolts 32 and 34. The bolts therefore act as pins across the top of the cable 44 and between side plates 10 and 12 which positively prevent the cable from being flipped off of the intermediate support when the cable is slackened or tightened during skyline logging operations.

A support holder generally depicted as 46 includes a support holding tube 48 having a square cross section. The holding tube is bored at the base to receive the lower support holding arm 50. The support holding arm 50 is secured to the holding tube 48 by means of welding. The support holding arm 50 is inserted into bushings 52 and 54 which are located on sideplates 10 and 12 respectively. The bushings 52 and 54 provide for rotation of the side plate assembly 11, with respect to the support holding arm 50. An inner ring 56 is provided around the lower support arm 50. A cotter pin is inserted in hole of inner ring 56 then through hole 60 to retain the support arm 50 in the side plate assembly 11. The support holder 46 also includes an upper support holding arm 62 which is mounted in bore holes in the support arm holding tube 48. The arm 62 is secured to the holding tube 48 by means of welding. A hanger pin 64 is inserted into a bore hole in the arm 62, and rotation between the pin 64 and the arm 62 is permitted. Support hanger plates 66 and 67 are welded to the side of the support hanger pin 64. At the top of hanger plates 66 and 67 there is a support hanger pully 68 which is secured to the support hanger plates 66 and 67 by means of a pully shaft 70.

Referring now to FIG. 2, there is shown the support plate assembly 11, skyline cable 44, and a skyline logging carriage generally depicted as 72. The logging carriage has sheave wheels 74 and 76 which ride on the skyline cable 44 during transit of the logs. In FIG. 2, the logging carriage 72 is shown with sheave wheel 74 on cable 44, and with sheave wheel 76 above the cable 44 and riding upon the outward sloping faces 82 and 84 of the side plates 10 and 12 of side plate assembly 11. Extending generally downward from the carriage 72 is a carriage hanger 78 which carries the chokers or other means to secure the logs to the carriage.

The carriage 72, by riding over the top of the side plate assembly 11, disengages the cable 44 and makes it possible to retain the cable in the intermediate support by retention means which in this embodiment comprises bolts 32 and 34.

Figure 3:
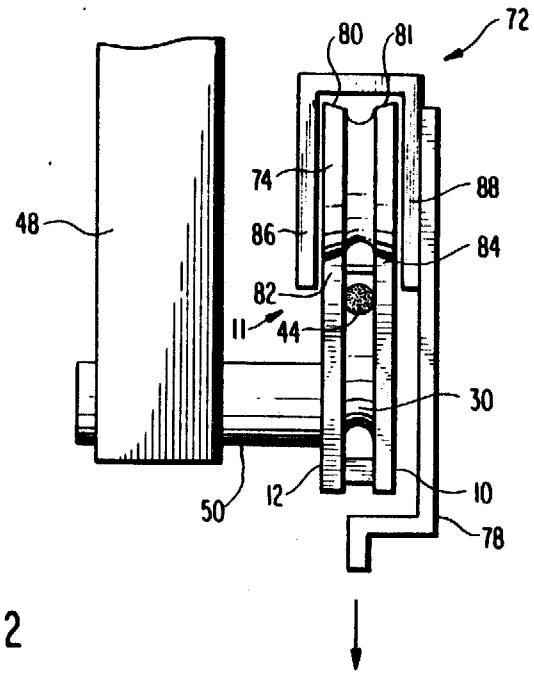
FIGS. 3 and 4 show end views of the intermediate support and the logging carriage as the carriage is on top of the support.
Figure 4:
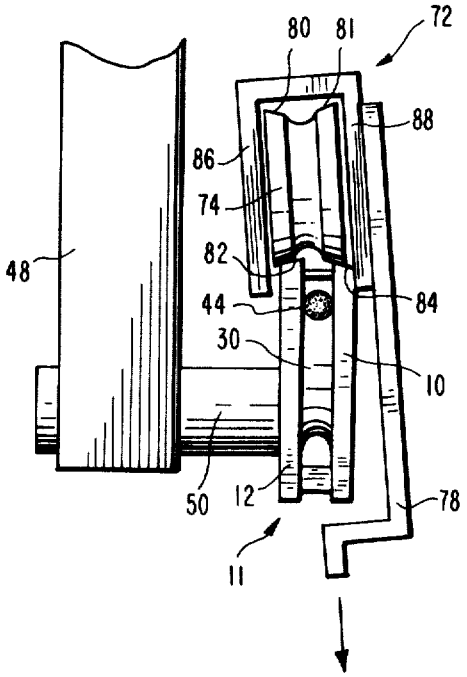

In FIG. 3 and FIG. 4 there is shown the intermediate support 11 with the logging carriage 72 riding over the top of side plates 10 and 12. The carriage sheave wheels 74 and 76 each have inwardly sloping faces 80 and 81 which, in combination with outward sloping faces 82 and 84 on side plates 10 and 12, right the sheave wheels 74 and 76 on top of the support assembly 11. FIG. 3 also allowing the carriage assembly 72 to rock from side to side while crossing the support assembly 11, FIG. 4. The faces 82 and 84 comprise the carriage sheave tracks at the top edges of the side plates 10 and 12. Further, the carriage assembly 72 may also include skirt plates 86 and 88 which may encompus a skyline lock to prevent the carriage 72 from jumping off skyline cable 44, and to prevent the carriage 72 from slipping off of the support assembly 11 during its transit over the assembly 11.

The above description of the preferred embodiment should not in any way limit the scope of the invention disclosed herein or the claims appended hereto.

What is claimed is:

1. A skyline intermediate support for use in a skyline logging system, which system includes a carriage having sheave wheels which travel over a skyline cable, and means to slacken the skyline cable to allow attachment and removal of logs, comprising in combination:

(a) first means for allowing said carriage to disengage said cable and to pass on the intermediate support;

(b) sheave wheel means mounted on said first means for allowing said skyline cable to pass freely through the intermediate support and below said carriage as it passes on the intermediate support; and (c) cable retention means attached to said first means for preventing said cable from disengaging the intermediate support when said cable is slackened and tightened during logging operations.

2. The apparatus of claim 1 further comprising a support holder for suspending said intermediate support.

3. The apparatus of claim 1 wherein said first means for allowing said carriage to disengage said cable comprises:

(a) two side plates having outward sloping carriage sheave tracks at the top edges.

4. The apparatus of claim 3 wherein said side plates are parallel to each other, and lie generally parallel to the direction of the skyline cable.

5. The apparatus of claim 4 further including spacer block means mounted between said side plates which maintain a fixed relationship between said parallel side plates.

6. The apparatus of claim 3 further comprising end nose block means connected to said side plates which provide for plate separation and for guiding a slack cable through said intermediate support, and for providing means to open carriage skyline locks.

7. The apparatus of claim 3 wherein said cable retention means is located between said side plates and above said sheave wheel means whereby said retention means, said side plates, and said sheave wheel means completely surround said skyline cable to prevent disengagement of said cable from the intermediate support.

8. The apparatus of claim 7 wherein said cable retention means comprises bolts placed between said side plates.

* * * * *